US005592789A

United States Patent [19]

Liddell, Sr. et al.

[11] Patent Number: 5,592,789

[45] Date of Patent: Jan. 14, 1997

[54] MODULAR SUPPORTING STRUCTURE

[75] Inventors: William D. Liddell, Sr., Boston, Mass.; Raymond W. Hawes, Peterborough, N.H.

[73] Assignee: American Containment Systems, Inc., Boston, Mass.

[21] Appl. No.: 490,060

[22] Filed: Jun. 13, 1995

[51] Int. Cl.[6] ..... E04B 1/19

[52] U.S. Cl. ..... 52/63; 52/222; 52/86; 52/93.1; 52/654; 52/655.1

[58] Field of Search ..... 52/63, 222, 653.1, 52/653.2, 655.1, 93.1, 262, 22, 86, 87, 654.1; 211/189, 191, 182

[56] References Cited

U.S. PATENT DOCUMENTS

| | | | |
|---|---|---|---|
| 3,045,834 | 6/1962 | Seiz | 211/191 |
| 3,708,928 | 1/1973 | Gaspers . | |
| 4,569,451 | 2/1986 | Parrott et al. | 211/182 X |
| 4,707,953 | 11/1987 | Anderson et al. . | |
| 4,961,297 | 10/1990 | Bernard | 52/93.1 |
| 5,076,031 | 12/1991 | Hancock . | |
| 5,159,790 | 11/1992 | Harding | 52/86 |
| 5,237,785 | 8/1993 | Lukes | 52/86 |
| 5,269,106 | 12/1993 | Stafford et al. | 52/86 X |
| 5,388,311 | 2/1995 | Solbeck . | |

OTHER PUBLICATIONS

Monarflex Brochure—Jul. 1991.
Hakitec Brochure—Jan. 1990.

*Primary Examiner*—Carl D. Friedman
*Assistant Examiner*—Timothy B. Kang
*Attorney, Agent, or Firm*—Perman & Green

[57] ABSTRACT

A supporting structure is comprised by a plurality of elongated base structural members each having first and second ends defining the length thereof and each base structural member being defined in part by a hollow tubular portion extending coextensively therewith. The hollow tubular portions each have a given width defined by opposed transverse sides. A plurality of bracing members are provided and each have first and second ends which define the length thereof. Attachment means are formed on the first and second ends of the bracing members for engaging with a surface on one of the plurality of elongated base structural members to effect a connection therebetween. Each of the plurality of elongated base structural members have a keyhole slot formed in the transverse sides thereof. The keyhole slots are sized and shaped to receive and hold the attachment means formed on the first and second ends of the bracing members. Each of the plurality of elongate base members includes a bolt securement channel integrally formed as part of the hollow portion thereof and extending coextensively with the length of each base structural member for receiving and locking a bolt to be secured within the base structural member.

16 Claims, 11 Drawing Sheets

MODULAR SUPPORTING STRUCTURE

BACKGROUND OF THE INVENTION

The present invention relates to a temporary structure used for shelters or the like and/or relates to a structure used in containment systems wherein an object, building or other structure is sealed to the environment to contain airborne contaminants, and relates more particularly to such a structure wherein the components thereof are capable of being readily assembled without need of numerous bolt connections and the requisite tools required for such assembly.

The formation of supporting structures for temporary shelters and/or containment enclosures inherently need to be both lightweight and capable of withstanding the loads imposed by elements, such as, wind, rain, and snow. Because these structures are usually covered with air impermeable sheathing, they are subjected to the same loading conditions experienced by a building. Wind loads are a major design factor and concern with such structures. This is because these structures have very expansive surface areas which are exposed to wind forces. Therefore, the structure which supports the enclosing sheathing must have sufficient strength to withstand these applied loads. In addition, such structures should also be preferably formed from a lightweight material which would allow it to be readily handled by workers. In the past, the supporting structures were fabricated from preformed building elements which required a multiplicity of bolting connections as between vertical support members, horizontal trusses and bracing or purlin members. Such connections require numerous man-hours in the assemblage of the structure, given that each connection must be secured by virtue of bolting the members together. It is also desirable to provide building elements of a type which have a low linear weight which allows for longer unsupported spans and requires less substantial vertical supports. The aspect of providing lightweight members has further importance in that it allows for the entire structure to be lifted, for example, by a crane and lowered into place over a desired footprint or a structure to be contained. Additionally, such structures must be capable of readily attaching a protective covering or sheathing to the underlying structure. In the past, it was known to use fixing timbers which were separately attached by clamping to the structure at points along the individual truss members. The sheathing was then attached to the truss structure by nailing it to the wooden fixing members. The problems attendant to these known fixing systems were that the fixing members were heavy and cumbersome, and added unwanted weight to the structure. Additionally, the securing of the wooden fixing beams to the truss structure involved additional labor which added time and, hence, cost to the project. Also, it is important to maintain the uniform spacing of the truss members so that a predictable arrangement of truss members can be fabricated. This is because when the securement points are oriented at uniform spacings, it is easier to secure the sheathing to the underlying support structure when the location of these points are known.

Accordingly, it is an object of the present invention to provide a supporting structure comprised of a plurality of standardized structural elements which are assembled together without the heretofore known use of bolting connections existing as between bracing and truss members and to provide a structure of such construction which allows numerous components of the structure to be assembled by a drop-in-place joint design.

It is a further object of the invention to provide individual structural elements of a standardized form useable together in a supporting structure made up of a plurality of such standardized structural elements configured to provide spans which have high bending strength and which deliver very high strength to weight ratios.

Still a further object of the invention is to provide a supporting structure which is modular in construction as defined by individual elements of predetermined and standardized constructional form having connections which allow successive repetitions of structural segments to be created along a given span of a truss.

Still a further object of the invention is to provide a supporting structure of the aforementioned type wherein the standardized structural elements each has a means for readily connecting it to sheathing material at infinite locations taken along its length.

Other objects and advantages of the present invention will become apparent from the following description and the appended claims.

SUMMARY OF THE INVENTION

The invention resides in a building structure constituted by preformed building elements of standardized form which are interconnected with one another in a manner which avoids the otherwise necessary connection of bolting between transverse structural members. The supporting structure is comprised of a plurality of elongated base structural members each having first and second ends defining the length thereof and each base structural member being defined in part by a hollow tubular portion extending coextensively therewith. The hollow tubular portion of each member has a given width defined by opposed transverse sides. A plurality of bracing members are also provided, each having first and second ends which define the length thereof. Attachment means are formed on the first and second ends of the bracing members for engaging with a surface on one of the plurality of elongated base structural members to effect a connection therebetween. Each of the plurality of elongated base structural members have a keyhole slot formed in the transverse sides thereof. The keyhole slots being sized and shaped to receive and hold the attachment means formed on one of the first and second ends of the bracing members. Each of the plurality of elongate base members includes a locking bolt securement means integrally formed as part of the hollow portion thereof and extending coextensively with the length of each base structural member for receiving and locking a bolt to be secured within the securement means.

The invention further resides in a free standing supporting structure comprised of a plurality of first vertical support elements disposed in a row along one side of a central axis of the supporting structure and bearing on a support surface, a plurality of second vertical support elements disposed in a row along another side of the central axis of the structure and bearing on a support surface, and a plurality of roof truss members, each comprised of upper and lower cords spaced apart to define the height of the roof truss members. Each of the roof truss members having opposite ends each associated with one of the first and a second vertical support elements so as to be supported thereby above the support surface. Each of the first and second vertical support elements having first and second subpart members which are fixed thereto in a parallel orientation and spaced from one another by the height of the roof truss member. The first and second vertical support members being comprised of vertical upstanding inner and outer cords which connect to the first and second subpart members to maintain the first and second subpart members in the parallel spatial relationship. The first and second subpart members being comprised of a hollow tubular portion which is directed towards the juxtaposed end of the roof truss member to which it is connected. A means is associated with the ends of the upper and lower cords of the roof truss members for connecting within the hollow tubular portions of the first and second subpart members of each vertical support element so as to form a self-supporting roof structure. A means is provided for connecting successively ordered ones of the roof truss members with one another and successively order ones of the vertical support members to one another for bracing same against movement.

DETAILED DESCRIPTION OF THE PREFERRED EMBODIMENT

Figure 1:
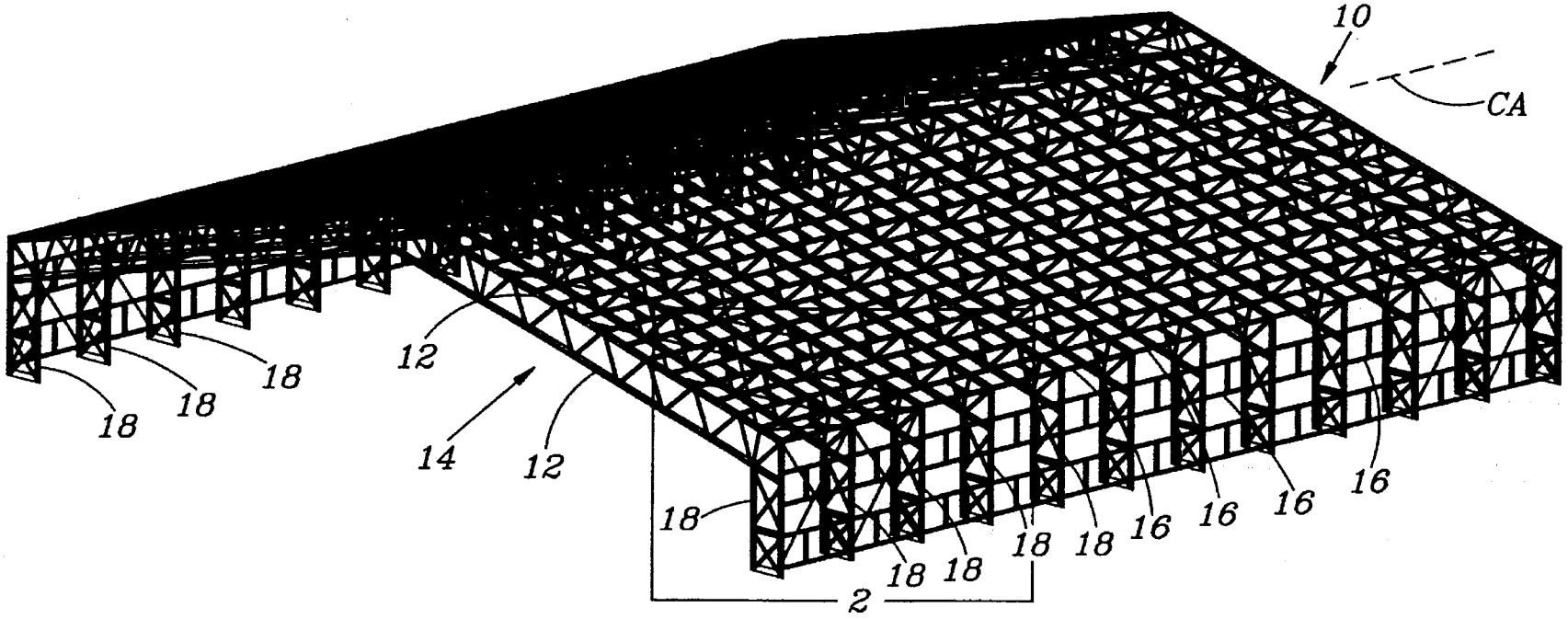
FIG. 1 is a perspective view of the supporting structure of the present invention.

FIG. 1 illustrates a supporting structure designated generally at 10 which is made up of a plurality of preformed standardized base members 12,12 which together comprise a network of connected elements defining roof truss members 14,14 and upstanding vertical support elements 18,18 which are supported by the ground G or other comparable surface. The roof truss members 14,14 and vertical support elements 18,18 are secured against movement relative to the central axis CA of the structure 10 by a plurality of bracing members or purlins 16,16 which extend in a direction parallel to the central axis CA, and are releasably yet rigidly connected to the members 14,14 and elements 18,18 in accordance with one aspect of the invention.

Figure 2:
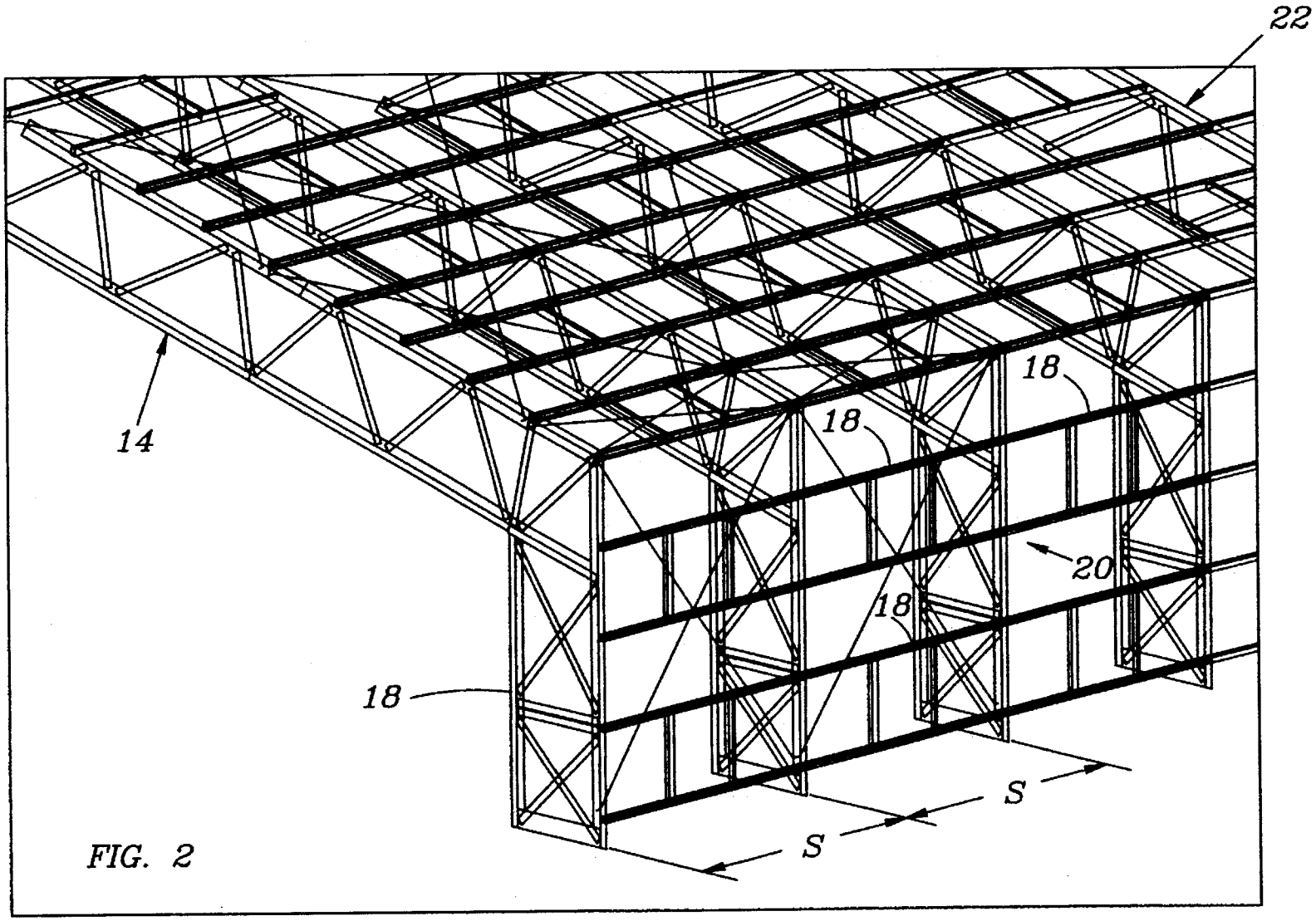
FIG. 2 is an exploded view of the section captioned as "2—2" in FIG. 1.
Figure 3:
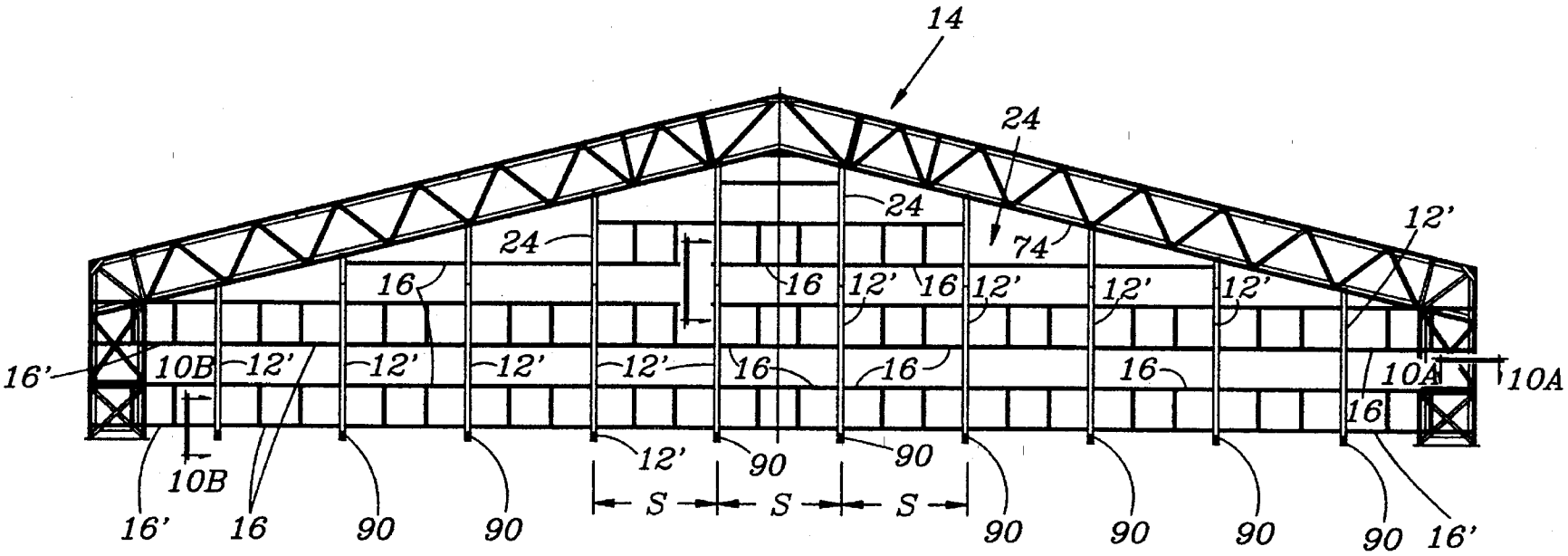
FIG. 3 is a front elevation view of the supporting structure illustrated in FIG. 1 shown here with an endwall supporting structure.
Figure 10B:
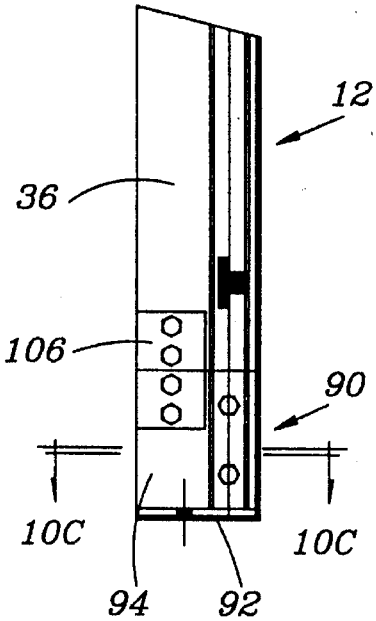
FIG. 10*b* is a partially fragmentary view of a footing.
Figure 10C:
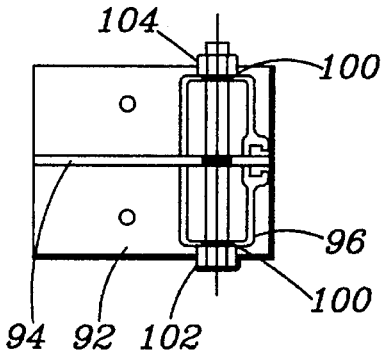
FIG. 10*c* is a horizontal section taken along line 10*c*—10*c* of FIG. 10*b;*

As best illustrated in FIG. 2, each of the roof truss members 14,14 connects at its opposite ends to an upstanding vertical support element 18 and each of which elements 18,18 being disposed along either side of the central axis CA of the structure and are spaced apart from one another at the indicted spacings S. The upstanding vertical support members 18,18 are maintained in the spatial relationship indicated by the spacing dimensions SS by the ones of the purlin members 16,16 which are vertically oriented and thusly constitute the sidewalls 20,20 of the structure. Similarly, the purlins which connect with the upper truss members 14,14 along the top of the structure 10 constitute the roof supporting surface 22. As illustrated in FIG. 3, the front and rear faces of the structure 10 are defined by endwalls comprised of a plurality of purlin members 16,16 and 16',16' which extend perpendicularly to the central axis CA of the structure 10 and connect to one another through vertically disposed ones of the base members 12',12'. These vertically disposed base members 12',12' are connected to end the lower cord of the roof truss 14 at the top ends thereof to maintain the purlins 16,16 in a vertically spatial relationship with one another so as to form the endwalls 26,26. The opposite ends of these members connect to footing members in a manner which will be discussed in greater detail with respect to FIGS. 10*b* and 10*c*. In this way, it should be seen that the support structure 10 provides front and rear endwall faces 26,26, sidewalls 20,20 and a roof surface 22 which provide a means for attaching sheathing to the structure to effectively create an enclosed sealed environment therein.

Figure 4A:
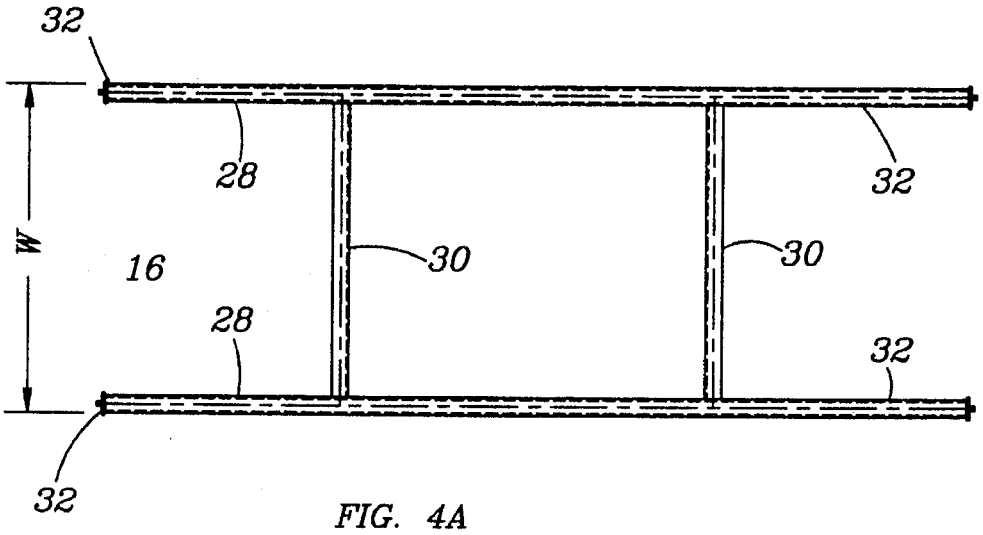
FIG. 4*a* is a plan view of a purlin or bracing member of the structure.
Figure 4B:
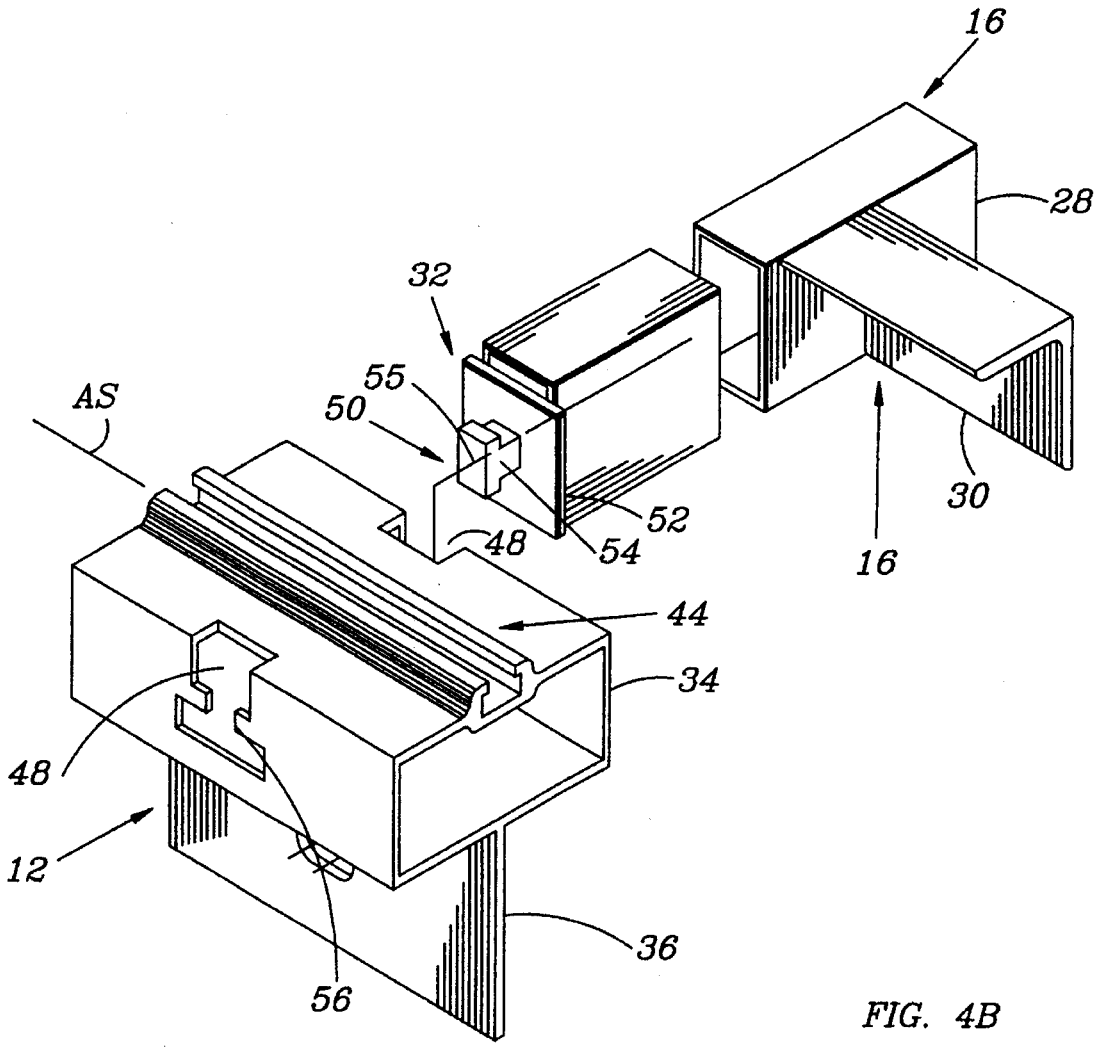
FIG. 4*b* is a partially fragmentary perspective view of a truss member to purlin connection.
Figure 14:
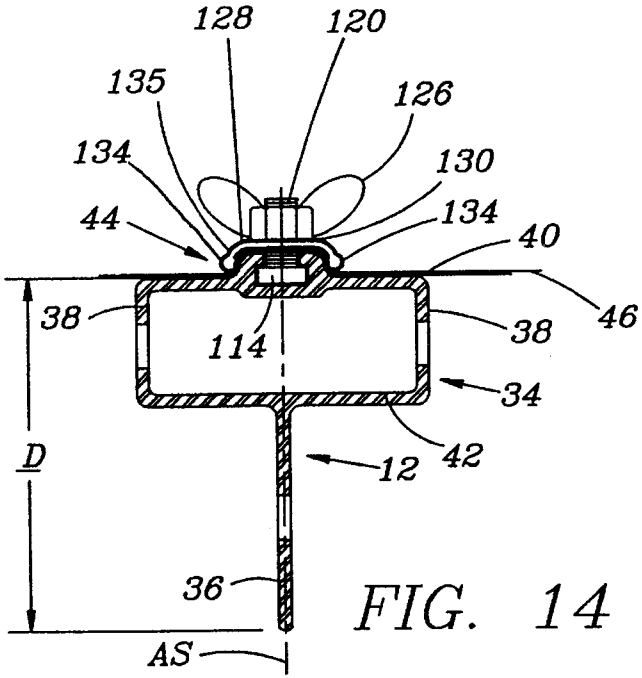
FIG. 14 is a partially fragmentary vertical sectional view taken through the rightmost base structural member of FIG. 13 illustrating the securement of the sheathing to the structural member.

Referring to FIGS. 4*a* and 4*b*, and in particular to the connection between the base structural members 12,12 and the bracing members 16,16, it should be seen that each bracing or purlin member 16,16 is a generally H-shaped member comprised of two main elongated parts 28,28 rigidly connected with one another in a spatial relationship by transverse bracket parts 30,30 which connect to the transverse sidewalls of the elongated main parts 28,28 through the intermediary of a weldament or a like connection to define the width dimension of the purlin. Disposed at the opposite ends of each of the main parts 28,28, is an attachment means 32,32 provided thereon for the purpose of removably yet rigidly connecting the purlin to the transverse side of any one of the base structural members 12,12. To these ends, as best illustrated in FIG. 4*b* and in FIG. 14, each base structural member 12 is formed as a symmetrical unitary extruded aluminum member defined by a generally rectangular hollow tubular portion 34 and an integrally formed web member 36 which is disposed coincidentally with the axis of symmetry AS of the base member and which symmetry axis is coincident with the central axis of the base member. In the preferred embodiment, the base structural members 12,12 each have a depth d equal to only about 6 inches and a wall thickness of 3/16 of an inch. This is because tubular and web portions combine to render a member which is highly resistant to bending, while providing a highly lightweight construction relative to members which have heretofore been used. As seen in FIG. 14, the hollow tubular portion 34 of each of the structural members 12,12 is defined by integrally formed sidewalls 38,38, and an endwall 40, and a base wall 42 each extending transversely of the sidewalls 38,38, with the web member 36 being integrally formed with the base wall 42. As will become apparent later, the endwall 40 is formed with a means 44 which is symmetrically disposed about the axis of symmetry AS, and is provided for the purpose of attaching a sheathing material, indicated generally as 46 in FIG. 14, to the involved base structural member.

Each of the structural members 12,12 is provided with a plurality of keyhole slots 48,48 formed in the hollow tubular portion 34 thereof. Each keyhole slot is formed partially in the endwall 40 and partially in the adjacent one of the sidewalls 38,38 of the hollow tubular portion 34 of the member. By the term keyhole, it is meant that the slot has a necked portion 56 which narrows the slot midway of its height from an otherwise wider configuration. This necked portion is important in effecting the securement of the attachment means 32,32 to the base structural members 12,12.

The attachment means 32 disposed on each free end of the main parts 28,28 of the purlin member 16,16 is comprised of a generally T-shaped projection 50, an outwardly disposed enlarged block portion 55 and a stem portion 54 fixed to an end plate 52 which is in turn fixed to the end face of the purlin 16 by a weld. The T-shaped projection 50 is correspondingly sized and shaped to be received within the keyhole slot 48. The stem portion 54 of the projection 50 is configured so as to be capable of being passed through the necked portion 56 of the keyhole slot 48 and thereafter be held by gravity in the larger slot portion disposed below the necked portion 56 to lock it in place being that the base structural members 12,12 are not disposed parallel to the horizontal in the system, but rather are inclined relative thereto. This feature is also important in that it enables the purlin member 16 to be attached to a base structural member 12 at a reversed orientation disposed 180 degrees from that illustrated in FIG. 4*b*.

Figure 5:
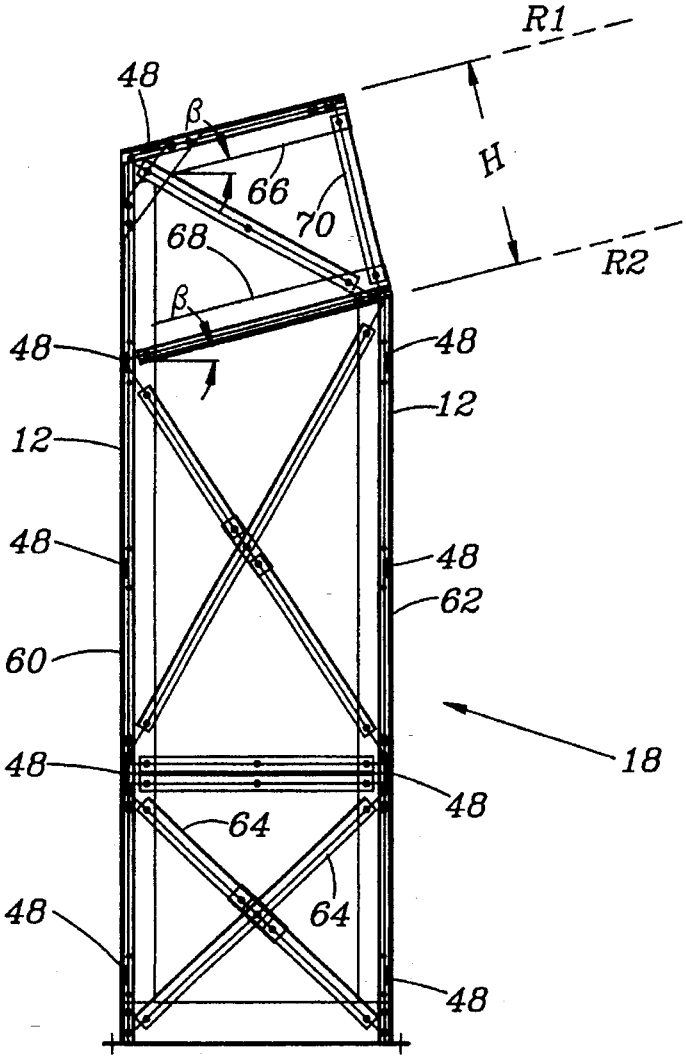
FIG. 5 is a side elevation view of a vertical support element.
Figure 6:
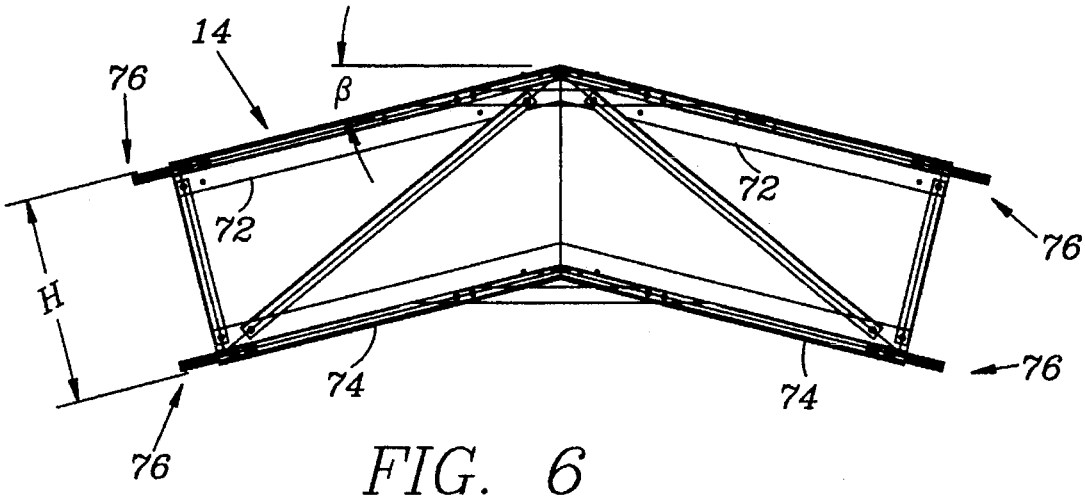
FIG. 6 is a front elevation view of the apex of the roof truss member of the structure.

FIG. 5 illustrates a vertical support element 18 comprised of an outer cord 60 and an inner cord 62 which are connected in a spatial relationship with one another through the intermediary of cross-bracing members 64,64. As illustrated, the length of the outer cord member 60 is greater than the length of the inner cord member 62 by a dimension equal to approximately the height h of the roof truss member 14 as defined by the distance separating each of the top and bottom cords 72 and 74. Each of the vertical support elements 18,18 at the top ends thereof are each comprised of first and a second subpart members 66 and 68 which are disposed in a parallel relationship with one another, and are maintained a distance h apart from one another so as to be readily connectable to the top and bottom cords 72 and 74 of the roof truss member 14. The lower subpart member 68 connects between the upper free end of the inner cord 62 and a point on the outer cord 64 disposed intermediate its length. The lower subpart member 68 is connected between the inner and outer cords 62 and 64 at an angle B measured relative to the horizontal. Similarly, the top subpart member 66 connects at it outer end to the outer cord 60 by a bolting or the like and is disposed at an equal angle B relative to the vertical created by the outer cord 60 and is maintained in such relationship with the lower cord 68 by a spacing member 70 which connects by bolting to each of the subpart members 66 and 68 in the illustrated parallel relationship. It is noted that each of the vertical support elements 12,12 is a preformed structure which remains in inventory assembled as shown, and hence, are used on-site in the fabrication of the structure as a single structural component. Also, the subpart members 66 and 68 are shortened versions of the base structural members 12,12, with each member having the hollow tubular portion 34 thereof directed along lines R1 and R2 appropriately spaced to provide receiving openings to which the ends of the roof truss member 14 are connected. To these ends, as illustrated in FIG. 6, the roof truss member 14 being comprised of a top roof cord 72 and a bottom roof cord 74 of opposed base structural members 12,12, connect with the subpart members 66 and 68 through the intermediary of splice means 76,76 which are received within the hollow tubular portions 34,34 of each of the members 66,68 and 72,74 in a manner that will be discussed in greater detail with respect to FIGS. 7 and 8. For the moment, it should be understood that the splice means 76 is adapted to be received and secured within the hollow tubular portions of these members, and in this way, each roof truss member 14 is connected directly to an associated one of the vertical elements 18,18.

Figure 7A:
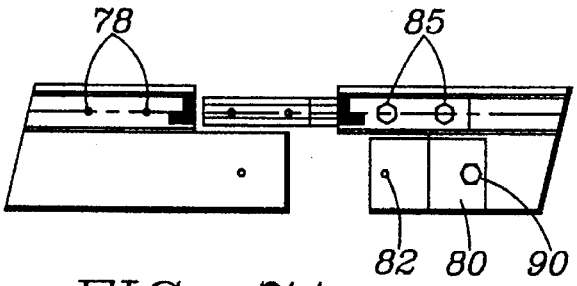
FIG. 7*a* is a partially fragmentary view of the end-to-end splice connection between co-aligned truss members shown prior to bolting.
Figure 7B:
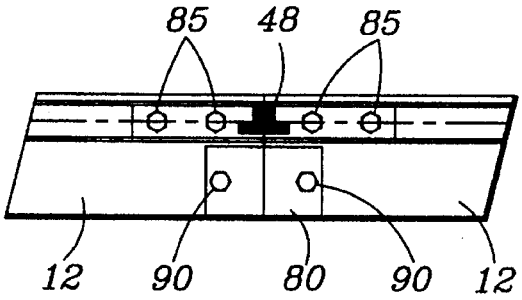
FIG. 7*b* is the connection of FIG. 7*a* shown in its bolted state.

Referring now to FIGS. 7*a* and 7*b*, the splice means 76 is shown in a typical connection between end-to-end connected base structure members 12,12. This connection is used for all end-to-end connected base members 12,12 throughout the structure 10 whether connected in a straight line or at an angle, such as in the case of the apex shown in FIG. 6. The means 76 includes splice openings 78,78 formed in each sidewall 38,38 of the base structural members 12,12, openings 80,80 formed in each web member portion 36,36 thereof, at least one splice plate 80,80 having openings 82,82 corresponding in location to the openings 80,80 in the web member portion 36 of the base structural members 12,12, and a tubular splice member 84 which is received within the hollow tubular portions 34,34 of the base structural members 12,12.

Figure 8A:
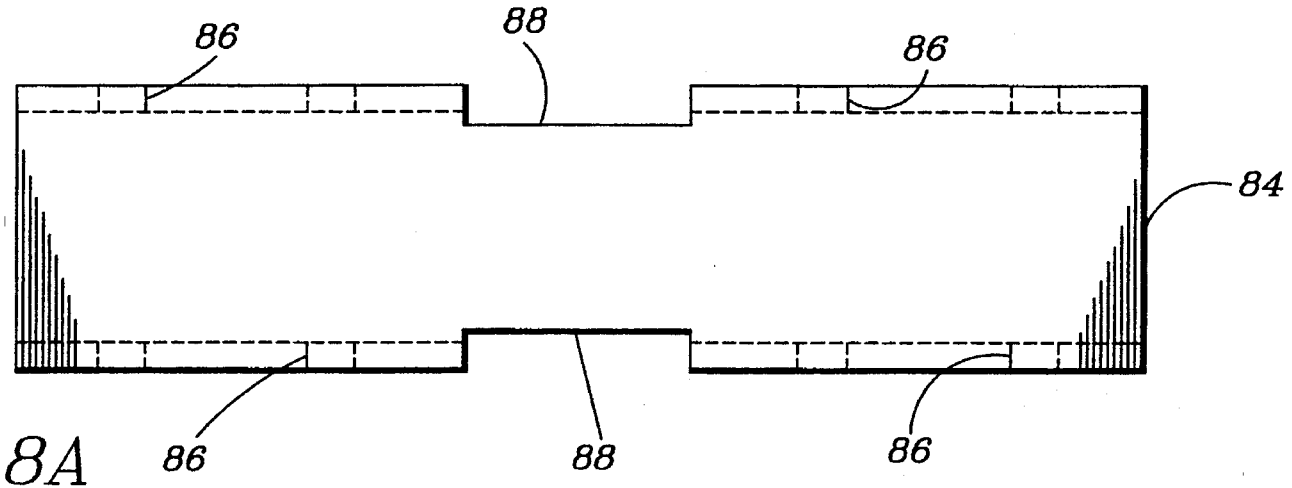
FIG. 8*a* is a top plan view of the connection splice used in the connection of FIG. 7*b;*
Figure 8B:
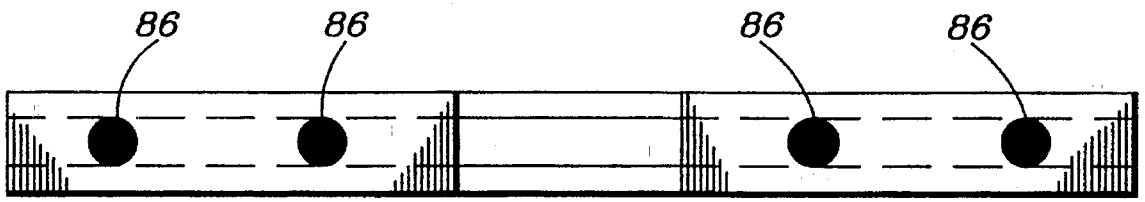
FIG. 8*b* is a side elevation view of the splice of FIG. 8*a;*
Figure 8C:
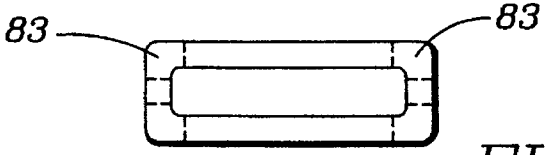
FIG. 8*c* is a front elevation view of the splice of FIG. 8*b;*
Figure 9:
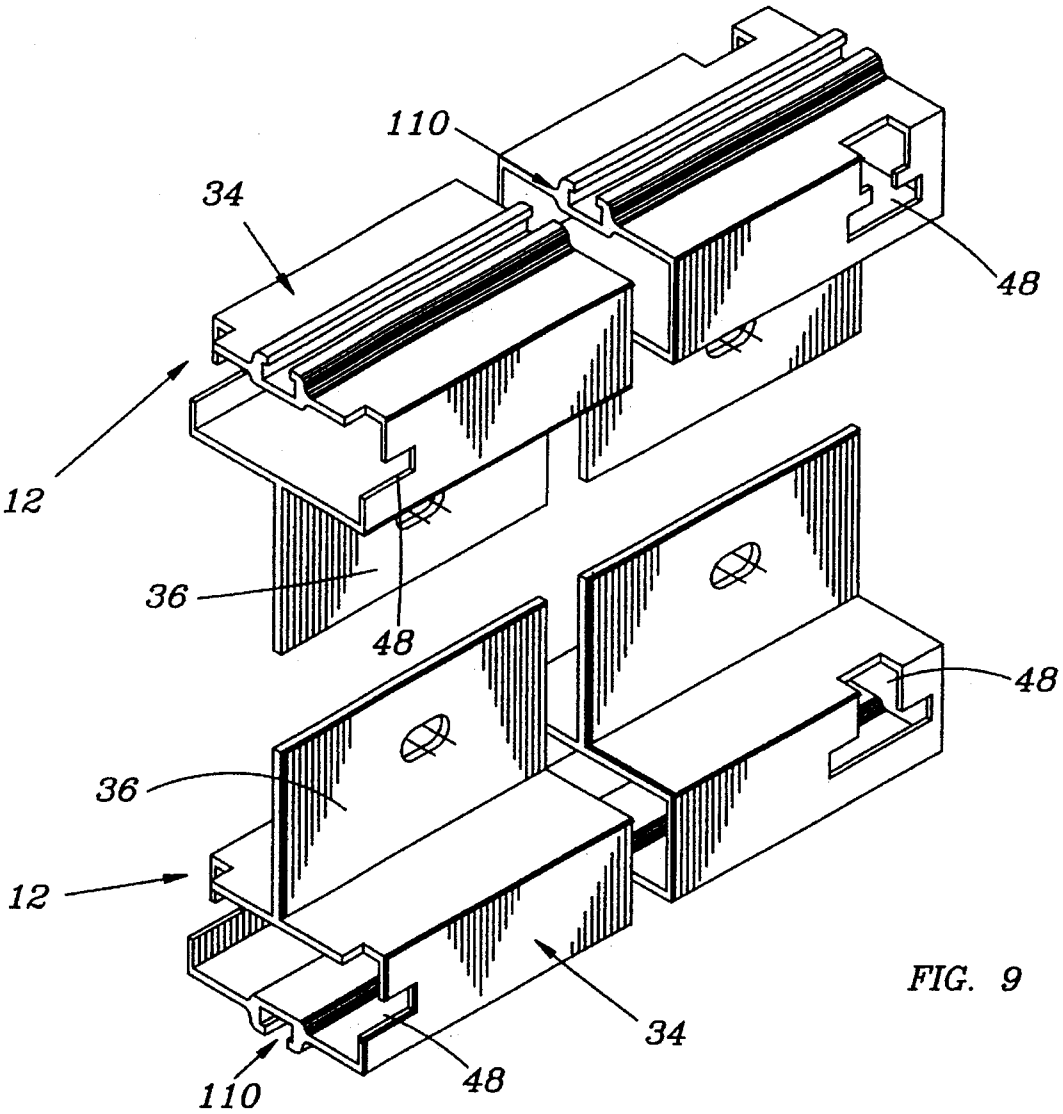
FIG. 9 is a partially fragmentary perspective view of upper and lower cord members disposed relative to one another in a beamlike configuration.

As best illustrated in FIG. 9, the distal ends of each of the base structural members 12,12 ends in a half-shape of the keyhole slot 48 which is a mirror image of a like half-shape keyhole slot formed on the distal end of an abutting one of the base structural members 12,12. In this way, as best illustrated in FIG. 7*b*, the abutting distal ends of the connected members 12,12 create a completed keyhole slot 48 which is formed from half component portions of the slots formed at each distal end of the members 12,12. The tubular splice member 84, as best illustrated in FIGS. 8*a* through 8*c* is correspondingly sized and shaped to be received snugly within the hollow tubular portion 34 of the base structural members 12,12 into which the splice 84 is inserted. The tubular splice member 84 is also provided with at least two pairs of openings 86,86 disposed within the lateral upstanding sidewalls 83,83 thereof, and which openings 86,86 are correspondingly sized and shaped to be aligned with the associated openings 78,78 formed in the hollow tubular portions 34,34 of each of the base structural members 12,12 which are being connected by the splice so that the splice is secured therein when a bolt and nut connection 85,85 is made. The tubular splice member 84 further includes opposed rectangular cut-outs 88,88 disposed midway along the length of the splice member which are defined by removed portions of the sidewalls 83,83 of the splice member 84. It should be understood that the placement of the openings 86,86 in the tubular member 84 and those corresponding openings 78,78 in the T-shaped structural members 12,12 is such as to locate the opposed cut-out portions 88,88 of the member 84 coincidentally with the formed keyhole slot 48 so as to be bisected by the abutting ends of the base members 12,12 when connected to one another by bolting members 90,90. The connection is further enhanced by the splice plates 80,80 which are bolted to the web portions 36,36 of the base members 12,12 by the boltings 90,90. The effect of the cut-outs 88,88 in the splice member 84 operate to permit the keyhole slot to function as if the tubular member 84 was not present because the cut-outs 88,88 are sufficiently deep to prevent interference with the projection 50 formed on the ends of the purlin members 16,16. Also, joint stiffness is enhanced by the presence of the projection 50 when the purlin to base member connection is made.

Referring back to FIGS. 2 and 5, it should be seen that the spacing of the keyhole slots 48,48 along the length of the base structural members 12,12 corresponds to the width dimension W of each purlin member 16,16. In this way, the purlin members 16,16 are readily connectable to the transverse side of the involved structural members 12,12 by simply inserting the projections 50,50 disposed at each distal end of the involved purlin through the top of the keyhole slot 48, past the necked portion 56 and through to a resting position at the bottom of the slot to thereby be maintained therein under the force of gravity.

Figure 10A:
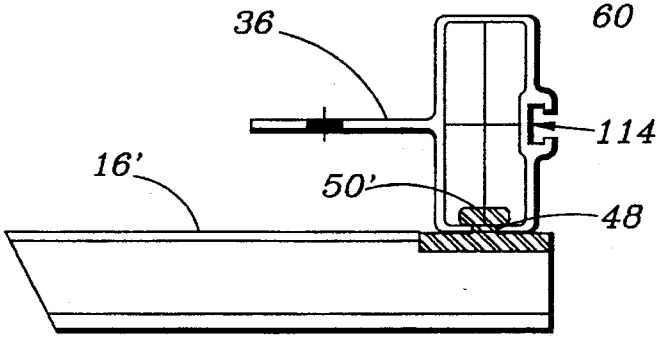
FIG. 10*a* is a partially fragmentary sectional view taken along line 10*a*—10*a* in FIG. 3.

Referring now to FIGS. 3 and 10*a*, it should be seen that certain of the purlin members identified as 16',16' are slightly modified in order to form the endwalls 26,26 of the structure 10. As best illustrated in FIG. 10*a*, the purlin 16' is essentially identical to the purlin 16 shown in FIG. 4, except that the illustrated right end thereof which connects to the outer cord 60 of the first vertical support element 18 is configured with a T-shaped projection 50' which extends laterally outwardly perpendicularly of the longitudinal extent of the member. The keyhole slot 48 of the member 60 is unmodified, and receives the T-shaped projection 50' so as to seat it at the bottom of the keyhole slot 48 when the projection 50' is moved through the necked portion 56 of the slot and then downwardly into engagement with the lower seating surface of the slot. The other opposite end of the purlin 16' is, however, unchanged and is configured identically to that shown in FIGS. 4*a* and 4*b*. Also, the remaining purlin members 16,16 which comprise the endwalls 26,26 are the same as those shown in FIGS. 4*a* and 4*b*, and are thusly readily connectable to the successively ordered ones of the vertically oriented base structural members 12',12' by connecting them in a standard way using the keyhole slots which are oriented horizontally in line with one another on the base structural members 12',12' across the end wall 26.

The vertically extending base members 12',12' which comprise the endwalls 26,26 each has a lower end which is connected to a footing 90,90. Each footing 90,90 is comprised of a baseplate 92 and a splice plate 94 bearing on the top surface of the baseplate so as to bisect the width of the plate. The footing 90 further includes a hollow tubular member 96 welded to the base plate 92 and is similar in construction to the hollow tubular portion 34 of the base structural members 12. The hollow tubular member 96 is, however, bisected into two halves by the splice plate 92 in the manner illustrated in FIG. 10*c*. The hollow tubular member 96 has coaligned openings 98,98 provided for the purpose of receiving a bolt 102 which clamps the splice plate 92 between the two halves of the member 96 under the action of a take-up nut 104. The footing splice plate 94 connects with the web member 36 of the base structural member 12 disposed above it through the intermediary of a pair of splice plates 106,106 which are bolted to the opposed end surfaces in a manner illustrated in the FIG. 10*b*. The vertical support elements 18,18 also incorporate like footings which use larger base plate members extending between the inner and outer cords of the vertical support elements.

Figure 11:
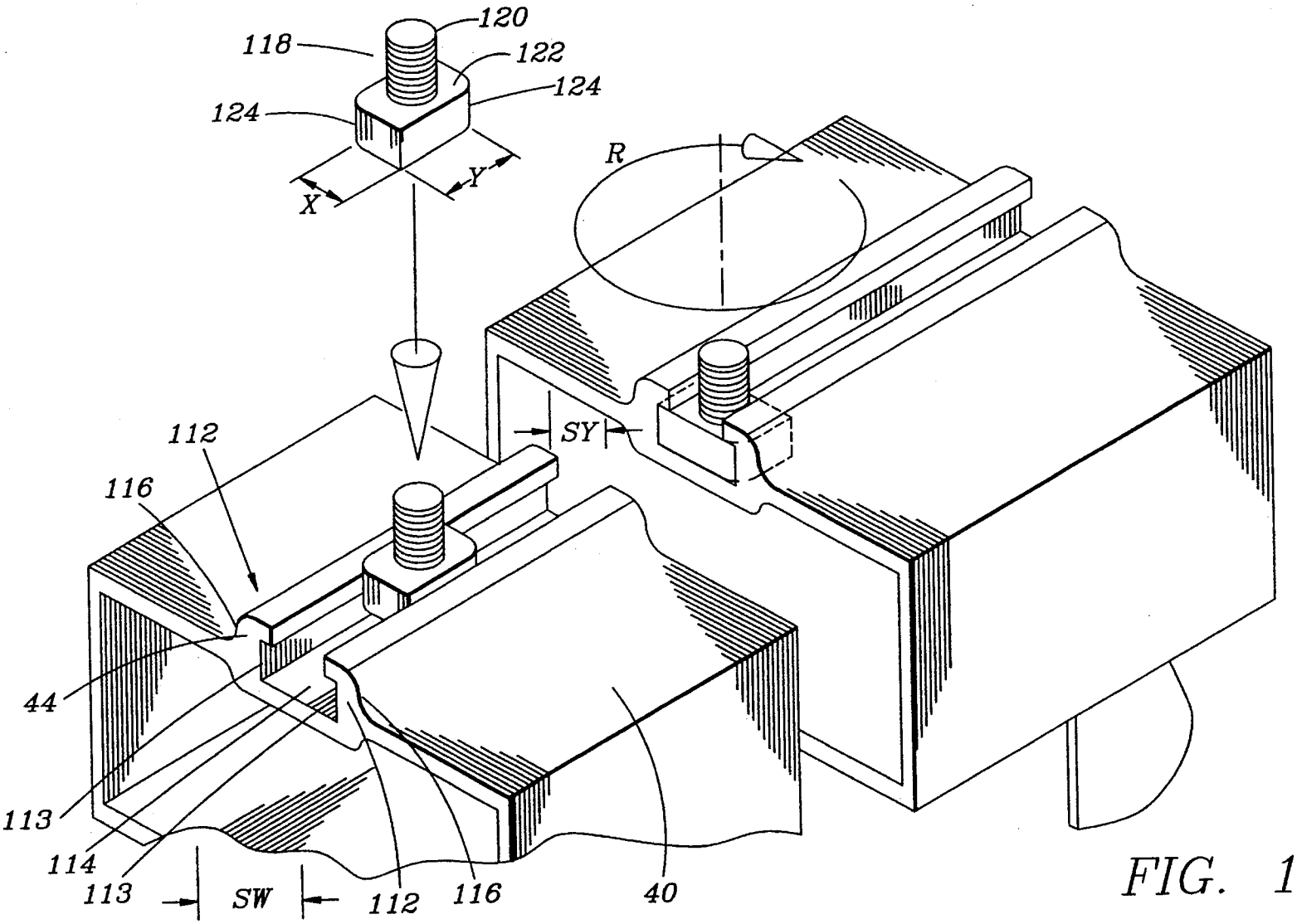
FIG. 11 is a partially fragmentary perspective view of a structural member showing the locking channel with a bolt connection.

Referring now to FIGS. 11 and 14, it should be seen each base structural member 12,12 is provided with means 44 disposed contiguously along its length for locking a connecting element with the base member 12 at infinite locations therealong. This means is integrally formed as part of the end wall 40 of the hollow tubular portion 34 of each base structural member 12,12. The means 44 takes the form of an inverted T-shaped slot defined by opposed necked portion 112,112 extending upwardly beyond the otherwise flat surface of the endwall 40 and communicating with a generally rectangular slot or channel 114 disposed coincidentally with the symmetrical axis AS of the member. As mentioned previously, the necked portions 112,112 extend outwardly beyond the otherwise flat surface of the endwall 40 yet are made contiguous with the endwall 40 through a concave curved surface 116,116 which blends with the flat regions of the wall 40 at tangent points which generate a smooth and contiguous outer surface. As will be discussed later with respect to the manner by which the sheathing becomes attached to the base structural members 12,12, this curvature assists sealing of the sheathing member with the supporting structure.

As illustrated in FIG. 11, the means 44 is provided as part of the base members 12,12 for receiving in locking engagement therewith a locking bolt 118 which includes an enlarged block portion 122 dimensioned to be received within the slot or channel 114 of the means 44. The locking bolt 118 has first and second dimensions, respectively, indicated by reference letters x and y giving it a generally rectangular boxlike shape. The dimension x corresponds generally to the spacing SP between opposed necked portions 112,112 but is slightly smaller so as to allow the block portion 122 of the locking bolt 118 to pass freely through the necked portions 112,112 and onto the bottom of the slot 114 when the bolt 118 is disposed with its dimension E oriented perpendicularly to the long dimension of the channel 114. The stem 120 of the bolt is sufficiently axially sized to extend outwardly beyond the necked area in a manner illustrated by the right side section shown in FIG. 11 once the locking bolt is seated within the channel. The channel 114 is defined in a lateral sense by opposed sidewalls 113,113 the spacing between which is illustrated by the dimensions SW. The block portion 122 of the locking bolt 118 is provided with opposed cam surfaces 124,124 which are configured to be rotated against the opposed sidewall surfaces 113,113 of the channel 114 when the locking bolt 118 is rotated in the illustrated rotational direction R. The rotational direction R coincides with the tightening direction of a locking nut 126, for example as shown in FIG. 14, so that the cam surfaces 124,124 of the locking nut are caused to wedge against the sidewalls 113 of the channel 114 upon the continued tightening of the nut.

Figure 12B:
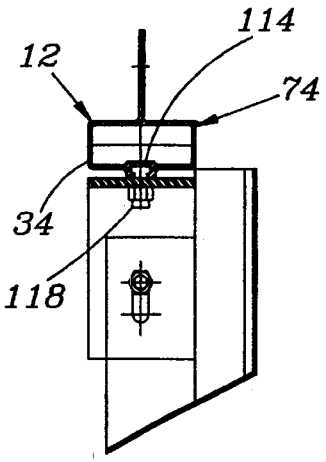
FIG. 12*b* is a partially fragmentary sectional view taken along line 12*b*—12*b* of FIG. 12*a;*
Figure 12A:
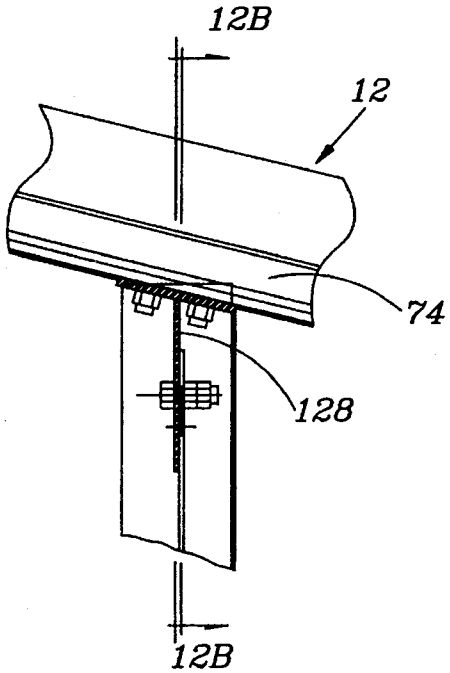
FIG. 12*a* is a partially fragmentary vertical sectional view of the connection between the lower cord of the roof truss and a vertically extending front face member.

The channel and locking bolt connection shown in FIG. 11 is used in the system not only to secure sheathing to the structure 10, but also to connect structural members to one another in the system. As seen in FIGS. 12*a* and 12*b*, this is the case in the endwall 26 construction and, in particular, with the connection of the vertically disposed base members 12',12' and the lower cord 74 of the roof truss member 14. Here, the locking bolt 118 is disposed within the channel 114 of the member 12, which constitutes the lower cord of the truss member 14, such that it depends therefrom and extends through openings formed in a connector 128. The connector 128 also bolts to the web portion 36 of the vertically disposed base member 12' and, thus it rigidly connects the member 12' to the lower cord 74 of the roof truss 14.

Figure 13:
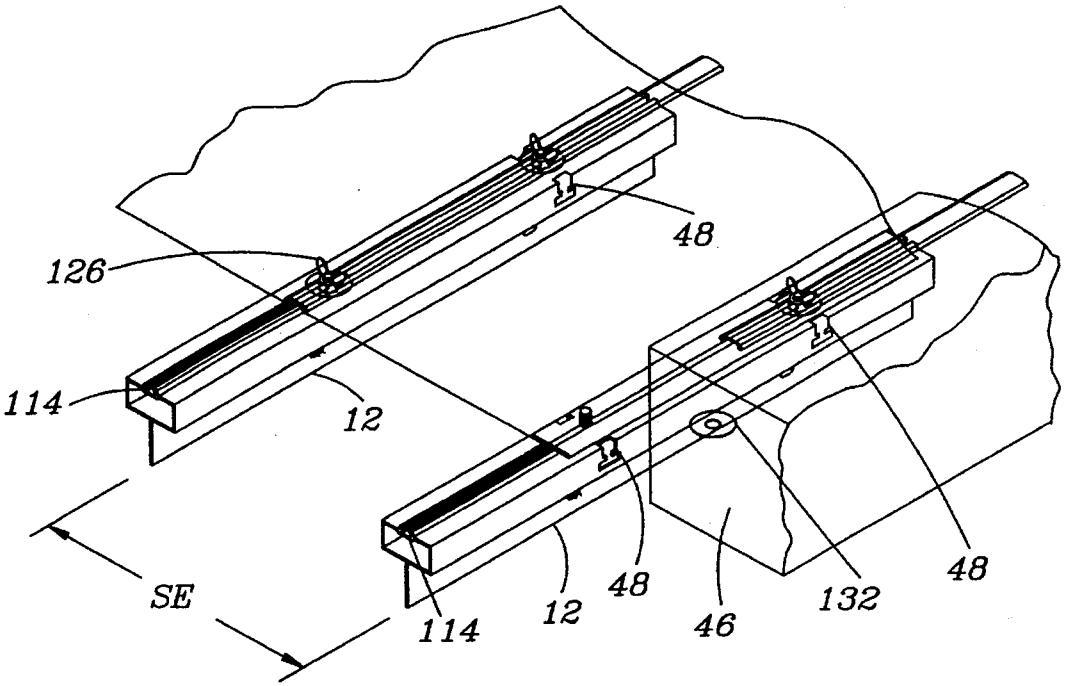
FIG. 13 is a partially fragmentary perspective view illustrating two base structural members oriented side-by-side with one another with sheathing material overlaid thereon.

Referring now to FIGS. 13 and 14, it should be seen that each of the base structural members 12,12 which comprise the roof support surface 22, the sidewalls 20,20 and endwalls 26,26 are oriented on the structure 10 so as to dispose the channels 114,114 of the means 44 in the endwall surface of each member 12,12 outwardly thereof. In this way, the external surfaces of the structure 10 as defined by the base members 12,12 are provided with infinite mounting locations for attaching the exterior sheathing to the structure 10. In the illustrated embodiment of FIG. 13, the sheathing 46 is one which is commercially sold and is of the type which may be provided with a plurality of preformed eyelets 132,132 arranged in a pattern and spaced from each other at given uniform intervals. The spacings between the eyelets 132,132 correspond to the spacing S,S existing between the base structural members 12,12 such that the eyelets 132,132 are capable of being aligned in a row with an involved one of the structural base members 12,12 so as to be positioned just over the channel 114 thereof. The sheathing 46 is attached to the base structural members 12,12 by first inserting a locking bolt 118 into the channel 114 at a point along its length corresponding generally to the location of an eyelet 132. Thereafter, the stem portion 120 of the locking bolt 118 is passed through the eyelet 132 and a clamping plate 128 is secured over the sheathing material. The clamping plate is provided with an elongated slot 130 which receives the stem portion 120 of the locking bolt therethrough. Upon tightening of the wing nut 126, the clamping plate is caused to bear down onto the sheathing 46 and to secure it against movement against the surface of the endwall 40 of the involved one of the base structural members 12,12. It should be appreciated that the clamping plate has curved distal end portions 134,134 which end in a holding beads 135,135 and are complimentarily shaped to be configured with the correspondingly curved shaped portions 116,116 of the base members 12,12. In this way, a sealed connection between the sheathing material is effected regardless of the type of sheathing material used. As illustrated in FIG. 13, this connection is particularly useful where two sheathing sheets are end-to-end connected with the other in an overlapping relationship.

By the foregoing, an improved supporting structure has been disclosed by way of the preferred embodiment. However, numerous modifications and substitutions may be had without departing from the spirit of the invention. For example, the sheathing material 46 has been disclosed as being one which incorporates preformed eyelet patterns formed on the material. However, it is well within the purview of the invention to use other covering materials, such as plastic films, which do not incorporate such eyelet patterns. In this alternative case, the stem portion 120 of the locking bolts 118,118 are simply passed through the covering material, in which a strip of reinforcement in the region of the connection may be provided. Also, while the structure has been described in the preferred embodiment as a self-support building, it is nevertheless within the scope of the invention to use sections of the structure 10, for example, the roof member, as a panel which can be placed over an open area to effect containment. Accordingly, the invention has been described by way of illustration rather than limitation.

Having thus described the invention, what is claimed is:

1. A supporting structure comprising:

(a) a plurality of elongated base structural members each having first and second ends defining the length thereof and each base structural member being defined in part by a hollow tubular portion extending coextensively therewith, the hollow tubular portion of each base structural member having a given width defined by opposed transverse sides;

(b) a plurality of bracing members each having first and second ends which define the length thereof;

(c) attachment means formed on said first and second ends of said bracing members for engaging with a surface on one of said plurality of elongated base structural members to effect a connection therebetween;

(d) each of said plurality of elongated base structural members having a keyhole slot formed in the transverse sides thereof, each of said keyhole slots being sized and shaped to receive and hold the attachment means of one of said first and second ends of said bracing members; and (e) each of said plurality of elongate base members including a locking bolt securement means integrally formed as part of said hollow portion thereof and extending coextensively with the length of each base structural member and exclusively of engagement with said attachment means for receiving and locking a locking bolt to be secured within said securement means at infinite positions therealong.

2. A supporting structure as defined in claim 1 further characterized in that said plurality of elongated base structural members being defined by said hollow portion and an integrally formed web portion creating a generally T-shaped member, said hollow portion thereof having a generally rectangular configuration as seen in cross-section and said transverse sides thereof being formed by opposed sidewalls, said opposed sidewalls being interconnected with a transversely extending endwall and with a transversely extending base wall with the web portion thereof being integrally formed with said base wall.

3. A supporting structure as defined in claim 2 further characterized in that said bracing members are purlins and said attachment means formed thereon on said first and second ends includes a T-shaped projection defined by an enlarged portion and a stem portion of reduced diameter each extending coextensively with the length dimension of the purlin.

4. A supporting structure as defined in claim 2 further characterized in that said bracing members are purlins and said attachment means formed on said first and second ends of said purlins includes a T-shaped projection defined by an enlarged portion and a stem portion of reduced diameter each extending perpendicularly to the length dimension of the purlin.

5. A supporting structure as defined in claim 4 further characterized by said bolt securement means for securing a locking bolt to said base structural member being defined by an elongated integrally formed channel in the endwall of said hollow portion of said base structural member, said channel being covered in part by opposed necked portions outwardly positioned relative to said channel and defining a passage having a given width, said channel being defined widthwise by two opposed sidewalls spaced at a distance substantially greater than the given width of said passage.

6. A supporting structure as defined in claim 5 further characterized by said plurality of base structural members being formed from an aluminum extrusion.

7. A supporting structure as defined in claim 6 further characterized by said opposed necked portions partially covering said channel being integrally formed with the end wall of said hollow portion of each of said elongated base structural members, each of said necked portions of said hollow portion meeting with the outer endwall surface along a curved surface blending contiguously with the endwall surface.

8. A supporting structure as defined in claim 7 further characterized by said locking bolt having a block portion and a stem portion and a clamping plate being connected to said base structural member by said locking bolt member, each of said clamping plates having a slot formed therein for receiving said stem portion of said locking bolt, wherein each of said clamping plates being formed with complimentarily curved surfaces which engage the corresponding curved surfaces formed on the endwall surface of said hollow portions of each of said base structural members.

9. A supporting structure as defined in claim 4 further characterized in that each of said keyhole slots formed in the transverse sides of each of said base structural members being defined by a slot half formed at each distal end of each base structural member, wherein ordered end-to-end connected ones of said base structural members being connected to one another by a splice means which causes each slot half to create a complete keyhole slot configuration.

10. A supporting structure as defined in claim 9 further characterized in that said keyhole slot being spaced along the lengths of said plurality of base structural members at spacings which are coincident with the spacings of the attachment means formed on each of said bracing members as taken along one side thereof.

11. A supporting structure as defined in claim 9 further characterized in that said splice means includes a tubular splice member sized and configured to be received within the internal confines of said hollow portion of each said base structural member, each of said splice tubular members including cut-outs disposed midway of its length and corresponding in position to the location of each half keyhole slot disposed at opposing distal ends of the connected base structural members.

12. A supporting structure as defined in claim 1 further characterized by each of said base structural members having a central axis which is coextensive with an axis of symmetry of said base structural members and said securement means integrally formed as part of said hollow portion of each of said base structural members being defined by a channel extending coincidentally with said central axis.

13. A free standing supporting structure comprising:

(a) a plurality of first vertical support elements disposed in a row along one side of a central axis of the supporting structure and bearing on a support surface, and a plurality of second vertical support elements disposed in a row along another side of the central axis of the structure and bearing on a support surface;

(b) a plurality roof truss members, each comprised of upper and lower cords spaced apart to define the height of the roof truss members, each of the roof truss members having opposite ends each associated with one of said first and a second vertical support elements so as to be supported thereby above the support surface;

(c) each of the first and second vertical support elements having first and second subpart members which are fixed thereto in a parallel orientation and spaced from one another by the height of the roof truss member, said first and second vertical support members being comprised of vertically upstanding inner and outer cords which connect to said first and second subpart members to maintain the first and second subpart members in said parallel spatial relationship;

(d) said first and second subpart members being comprised of a hollow tubular portion which is directed towards the juxtaposed opposite end of said roof truss member to which it is connected;

(e) means associated with the ends of each of the upper and lower cords of the roof truss members for connecting within the hollow tubular portions of the first and second subpart members so as to form a self supporting roof structure; and (f) means laterally connecting successively ordered ones of the roof truss members with one another and successively ordered ones of the vertical support members to one another for bracing same against movement.

14. A free standing support structure as defined in claim 13 further characterized by said structure having end walls defined by vertically extending base structural members which connect to the lower cord of the roof truss member disposed above it, and a plurality of bracing members connected between said vertically extending base structural members, said plurality of bracing members including end bracing members which connect between a base structural member and juxtaposed ones of said first and second vertical support elements.

15. A free standing supporting structure as defined in claim 14 further characterized by said inner and outer cords of said vertical support elements and said upper and lower cords of said roof truss members being comprised of base structural members each having a hollow portion and an integrally formed web portion, and wherein each of said base structural members having a plurality of keyhole slots formed therein for connecting with involved ones of said bracing members.

16. A supporting structure comprising:

(a) a plurality of elongated base structural members each having first and second ends defining the length thereof and each base structural member being defined in part by a hollow tubular portion extending coextensively therewith, the hollow tubular portion of each base structural member having a given width defined by opposed transverse sides;

(b) a plurality of bracing members each having first and second ends which define the length thereof;

(c) attachment means formed on said first and second ends of said bracing members for engaging with a surface on one of said plurality of elongated base structural members to effect a connection therebetween;

(d) each of said plurality of elongated base structural members having a keyhole slot formed in the transverse sides thereof, each of said keyhole slots being sized and shaped to receive and hold the attachment means of one of said first and second ends of said bracing members;

(e) each of said plurality of elongate base members including a locking bolt securement means integrally formed as part of said hollow portion thereof and extending coextensively with the length of each base structural member for receiving and locking a locking bolt to be secured within said securement means; and (f) said plurality of elongated base structural members being defined by said hollow portion and an integrally formed web portion creating a generally T-shaped member, said hollow portion thereof having a generally rectangular configuration as seen in cross-section and said transverse sides thereof being formed by opposed sidewalls of said generally rectangular configuration, said opposed sidewalls being interconnected with a transversely extending endwall and with a transversely extending base wall with the web portion thereof being integrally formed with said base wall.

* * * * *